US006799547B2

(12) United States Patent
Sieber

(10) Patent No.: US 6,799,547 B2
(45) Date of Patent: Oct. 5, 2004

(54) METHOD FOR STARTING A MULTI-CYLINDER INTERNAL COMBUSTION ENGINE

(75) Inventor: Udo Sieber, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,694

(22) PCT Filed: Feb. 7, 2001

(86) PCT No.: PCT/DE01/00467

§ 371 (c)(1),
(2), (4) Date: Oct. 25, 2002

(87) PCT Pub. No.: WO01/81759

PCT Pub. Date: Nov. 1, 2001

(65) Prior Publication Data

US 2003/0101956 A1 Jun. 5, 2003

(30) Foreign Application Priority Data

Apr. 26, 2000 (DE) ..... 100 20 325

(51) Int. Cl.[7] ..... F02N 17/00
(52) U.S. Cl. ..... 123/179.5
(58) Field of Search ..... 123/179.1, 179.5

(56) References Cited

U.S. PATENT DOCUMENTS 4,462,348 A * 7/1984 Giardini ..... 123/179.1
5,199,394 A * 4/1993 Hartmann et al. ..... 123/179.1
6,588,397 B1 * 7/2003 Sieber ..... 123/179.5

FOREIGN PATENT DOCUMENTS

| | | |
|---|---|---|
| DE | 31 17 144 A | 11/1982 |
| DE | 197 43 492 A | 4/1999 |
| EP | 0 569 347 A | 11/1993 |

* cited by examiner

*Primary Examiner*—Andrew M. Dolinar
(74) *Attorney, Agent, or Firm*—Michael J. Striker

(57) ABSTRACT

The invention relates to a method for starting a multi-cylinder internal combustion engine (1), in particular of a motor vehicle, in the forward direction, wherein the position of a piston (2) in a cylinder (3) of the engine (1) is ascertained, and fuel is injected into a combustion chamber (4) of the particular cylinder (3) whose piston (2) is in a working phase. To make it possible to start the engine reliably without an electric starter, independently of the position of the pistons (2) in the cylinders (3) before the starting process (14), it proposed that the engine (1) is first moved in the reverse direction, by the injection of fuel into a combustion chamber (4) of at least one cylinder (3) whose piston (2) is—viewed in the forward direction—in a compression phase, and the fuel compressed in the combustion chamber (4) of the at least one cylinder (3) is ignited, and the rotary motion in the reverse direction comes to a stop before the bottom dead center (UT) of the pistons (2) of the at least one cylinder (3) is reached, and that the engine (1) is then started in the forward direction.

15 Claims, 2 Drawing Sheets

METHOD FOR STARTING A MULTI-CYLINDER INTERNAL COMBUSTION ENGINE

BACKGROUND OF THE INVENTION

The present invention relates to a method for starting a multi-cylinder internal combustion engine, in particular of a motor vehicle, in the forward direction, wherein the position of a piston in a cylinder of the engine is ascertained, and fuel is injected into a combustion chamber of the particular cylinder whose piston is in a working phase.

The invention also relates to a multi-cylinder internal combustion engine, in particular of a motor vehicle. The engine includes a detector for ascertaining the position of a piston in a cylinder of the engine and a fuel metering system for injecting fuel into a combustion chamber of the particular cylinder whose piston is in a working phase. Finally, the present invention also relates to a control unit for a multi-cylinder internal combustion engine of this kind, in particular of a motor vehicle.

A method for starting a multi-cylinder internal combustion engine of the type defined at the outset is known for instance from German Patent Disclosure DE 31 17 144 A1. The method described there operates without an electric-motor starter. When the engine is at a stop, a quantity of fuel required for combustion is injected into the combustion chamber of one or more cylinders (starting cylinders), whose pistons are in the working phase, and is ignited. After that, fuel is injected into the combustion chamber of the cylinder or cylinders whose pistons are executing the next working stroke, and is ignited as soon as the applicable pistons have reached the working position. In this way, the engine can be embodied without an electric starter and the associated components required by such a starter. Moreover, a battery of the engine can be made smaller, since it no longer has to furnish energy for the starter and the other electrical components.

In the known method for starting an internal combustion engine, at one piston position of the starting cylinder near top dead center, only a relatively small quantity of air is contained in the combustion chamber of the starting cylinder. The resultant combustion energy from the combustion of the fuel injected into the combustion chamber can under some circumstances, because of the small air mass, may furnish too little starting energy, preventing the machine from being started. Moreover, the spacing between an injection valve, by way of which the fuel is injected into the combustion chamber, and the piston may be too slight, so that the fuel injected, as a consequence of penetration, changes virtually completely into a piston wall film that is hardly capable of evaporating.

German Patent Disclosure DE 197 43 492 A1 can also be referred to as further prior art; once again, it discloses a method for starting an internal combustion engine without an electric starter.

SUMMARY OF THE INVENTION

The present invention has the object of reliably starting a multi-cylinder internal combustion engine without an electric starter, regardless of the position of the pistons in the cylinders before the starting process.

For attaining this object, the invention, based on the method of the type defined at the outset, proposes that the engine is first moved in the reverse direction, by the injection of fuel into a combustion chamber of at least one cylinder whose piston is—viewed in the forward direction—in a compression phase, and the fuel compressed in the combustion chamber of the at least one cylinder is ignited, and the rotary motion in the reverse direction comes to a stop before the bottom dead center of the pistons of the at least one cylinder is reached, and that the engine is then started in the forward direction.

According to the invention, before the starter-free starting, the engine is accordingly first moved in reverse far enough that the pistons in the starting cylinder are in an optimal starting position. Since for starting the engine in the forward direction fuel is injected into the combustion chamber of a cylinder whose piston is in a working phase, the optimal starting position of the pistons—viewed in the forward direction—is immediately after top dead center. Because of this position of the pistons, combustion of the fuel injected into the combustion chamber of the starting cylinder can generate especially high combustion energy and thus also especially high starting energy.

Moreover, according to the invention, during the reverse motion of the engine, a relatively large air mass is aspirated into the combustion chamber of the particular cylinder which—viewed in the forward direction—is in the working phase. It can therefore be assured that the combustion energy, resulting from the combustion of the fuel injected into the combustion chamber of the starting cylinder, furnishes adequately high starting energy to enable reliable starting of the engine.

Finally, as a result of the reverse motion of the engine before the starting in the forward direction, the piston of the starting cylinder is moved away by the injection valve, so that when the fuel is injected into the combustion chamber of the starting cylinder, only very slight penetration, if any, occurs, and the injected fuel changes over virtually completely into an easily ignitable fuel-air mixture in the form of a fuel cloud.

In an advantageous refinement of the present invention, it is proposed that inlet and/or outlet valves of the at least one cylinder, whose piston is located—viewed in the forward direction—before its top dead center is put, before the starting process, into a position corresponding to the compression phase. To enable putting the valves into a predeterminable position, regardless of the engine, a camshaft-free control of the inlet and/or outlet valves is needed. Thus each inlet valve and outlet valve can be triggered separately from the other valves and independently of the position of the camshaft. For camshaft-free control, the inlet and/or outlet valves are equipped either individually or in groups of several jointly with an actuator device. The actuator device may function hydraulically, piezoelectrically, electromagnetically, or in some other way. From the prior art, many camshaft-free controls for inlet and outlet valves are known that can be used in conjunction with the method of the present invention. In accordance with the refinement, the valves can be opened and closed independently and—if the freedom of valve motion allows it—freely. In this way, it is successfully possible before or during the starting process to change from an aspiration phase to a working phase and vice versa. It is correspondingly also possible to change from a compression phase to an expulsion phase and vice versa.

In a preferred embodiment of the present invention, it is proposed that the inlet and/or outlet valves of two cylinders, whose pistons are located—viewed in the forward direction—before their top dead center are brought, before the starting process, into a position corresponding to the compression phase. Hence the engine is first put in a reverse direction, by injecting fuel into the combustion chambers of two cylinders whose pistons are—viewed in the forward direction—in a compression phase. Then, the fuel compressed in the combustion chamber of the two cylinders is ignited. As a result of the double combustion, sufficiently high combustion energy and thus a sufficiently starting energy are generated to overcome any static frictional or frictional and compression resistances of the engine, and initially to put the engine in a reverse motion reliably.

In another preferred embodiment of the present invention, it is proposed that during the rotary motion of the engine in the reverse direction, the inlet and/or outlet valves of a cylinder, whose piston is located—viewed in the forward direction—in an aspiration phase, are actuated in a targeted way such that the rotary motion of the engine in the reverse direction comes to a stop before bottom dead center of the pistons of the at least one cylinder is reached. By closing the inlet valves and outlet valves of a cylinder whose piston is in an aspiration phase, at the onset of the method of the invention or during the reverse motion of the engine, a pressure can be built up during the reverse motion in the combustion chamber by which the reverse motion is braked. By purposeful opening of the inlet and/or outlet valves, the level of the pressure building up in the combustion chamber during the reverse motion can be controlled, so that the rotary motion of the engine in the reverse direction comes to a stop precisely before bottom dead center of the pistons of the at least one cylinder is reached.

Advantageously, the inlet and outlet valves of the cylinder whose piston is located—viewed in the forward direction—in an aspiration phase, are closed during the rotary motion of the engine in the reverse direction.

Preferably, the inlet and outlet valves of the cylinder whose piston is located—viewed in the forward direction—in an aspiration phase, are kept closed for a predeterminable period of time after the reversal of the direction of rotation of the engine. As a result, the compression energy stored in the combustion chamber can be used to accelerate the crankshaft in the forward direction.

In another advantageous refinement of the present invention, it is proposed that during the rotary motion of the engine in the reverse direction, fuel is injected into a combustion chamber of a further cylinder, whose piston is located—viewed in the forward direction—in a working phase, and the fuel compressed in the combustion chamber of the at least one cylinder is ignited before—viewed in the reverse direction—the top dead center is reached. During the reverse motion of the engine, the injected fuel is compressed in the combustion chamber and finally ignited just before top dead center is reached. As a result of the compression of the fuel, the reverse motion—if it has not yet occurred—is braked to a standstill. Then by the ignition of the fuel, the engine is set into an opposed forward motion. This initiates the starter-free starting process in the forward direction.

In still another preferred embodiment of the present invention, then in the further course of the starting process, fuel is injected into a combustion chamber of a cylinder, whose piston is located—viewed in the forward direction—in an aspiration phase or a compression phase, and the fuel compressed in the combustion chamber of the at least one cylinder is ignited. The onset of injection into the combustion chamber of the further cylinder occurs for instance in the aspiration phase of the piston and takes place at an injection pressure which is built up by a prefeed pump, driven independently of the engine, of the fuel metering system. The prefeed pump is embodied for instance as an electric fuel pump driven independently of the engine. A prefeed pump, in a common rail fuel metering system, for instance, serves to pump fuel out of a fuel reservoir into a low-pressure region of the fuel metering system. However, the onset of injection can—if the injection pressure is high enough—also be shifted into the continuing compression phase until just before top dead center is reached. This kind of high injection pressure can be generated for instance by a high-pressure pump, operated independently of the engine, of the fuel metering system. In a common rail fuel metering system, for instance, the high-pressure pump pumps fuel out of the low-pressure region of the fuel metering system at high pressure into a high-pressure reservoir. From the high-pressure reservoir, injection valves branch off, by way of which fuel is injected out of the high-pressure reservoir into the combustion chambers of the cylinders. The high-pressure pump can be driven electrically, for instance. As a result of the combustion of the fuel injected into the combustion chamber of the cylinder, the rotary motion of the crankshaft in the forward direction is accelerated still further.

A proposed embodiment also covers the case where fuel, during the reverse motion of the engine, is injected into a combustion chamber of a cylinder whose piston is—viewed in the forward direction—in an expulsion phase. This is equivalent during the reverse motion of the engine to an aspiration phase. The fuel injected into this cylinder can then, during the forward motion of the engine, be ignited in the compression phase, preferably toward the end of the compression phase. It is understood that in this case as well, the injection onset can be shifted into the continuing compression phase—during the forward motion of the engine.

From the method of the invention, additional degrees of freedom are obtained in the starting process, and these can be utilized, among other purposes, for initiating a second attempt at starting after an unsuccessful first ignition. The first ignition may for instance be unsuccessful if the engine is not moving in the reverse direction, or if the first compression resistance could not be overcome. In a preferred embodiment of the present invention, it is proposed that after an first ignition of the fuel injected into the at least one cylinder has failed to succeed, the method is performed again, with inverted phases of the individual cylinders. That is, the method of the invention is accordingly—specifically, with inverted phases of the individual cylinders—performed. This means that by suitable actuation of the inlet and/or outlet valves, the cylinders that—viewed in the forward direction—were in a compression phase during the first attempt at starting are in an expulsion phase during the second attempt at starting, and vice versa. Moreover, the cylinders that during the first attempt at starting were in a working phase are shifted to an aspiration phase in the second attempt at starting, and vice versa. In the second attempt at starting, the injection of fuel into the combustion chambers and the ignition of the compressed fuel occur as described above.

To reduce the compression resistance during the starting process of the invention, in a preferred embodiment of the present invention it is proposed that during the starting process in a compression phase of a cylinder of the engine, the corresponding inlet valve of the cylinder is closed late. As a result, every compression phase that has been executed can advantageously be shortened by delayed closure of the corresponding inlet valves—which are opened during the aspiration phase that takes place before the compression phase. In this way, the crankshaft of the engine, because of the combustion at the onset of the starting process, can be much more easily put into a rotary motion in the forward direction, and the engine can be started correspondingly more easily.

Advantageously, the fuel compressed in a combustion chamber of a cylinder is ignited just before the top dead center of the piston of the applicable cylinder is reached, toward the end of the compression phase.

The realization of the method of the invention in the form of a control element, which is provided for a control unit of an engine, particularly of a motor vehicle, is of particular importance. In the control element, a program is stored in memory which can be run on a computing device, in particular a microprocessor, and which is suitable for performing the method of the invention. In this case, the invention is accordingly realized by means of a program stored in memory in the control element, so that this control element provided with the program represents the invention in the same way as does the method for whose performance the program is suited. As the control element, an electric storage medium can be used in particular, such as a read-only memory or a flash memory.

As a further way of attaining the object of the present invention, based on the multi-cylinder internal combustion engine of the type defined at the outset, it is proposed that the engine has means for performing the method of one of claims 1–11.

In an advantageous refinement of the present invention, it is proposed that the engine has a camshaft-free control of the inlet and/or outlet valves of the combustion chambers.

In a preferred embodiment of the present invention, it is proposed that the fuel metering system has a high-pressure pump, driven independently of the engine, for building up a fuel injection pressure.

As still another way of attaining the object of the present invention, it is proposed, based on the control unit of the type defined above, that the control unit has means for performing the method of one of claims 1–11. Accordingly, for starting an engine, the control unit not only carries out triggering of components of the engine that are involved in the starting process of the invention, in particular components of the fuel metering system and of the ignition. The control unit receives the command to start the engine from the actuation of an ignition key or starter button, for instance.

BRIEF DESCRIPTION OF THE DRAWINGS

Further characteristics, possible applications, and advantages of the invention will become apparent from the ensuing description of exemplary embodiments of the invention that are shown in the drawing. All the characteristics described or shown form the subject of the invention either on their own or in arbitrary combination, regardless of how they are summarized in the claims or their dependency, and regardless of how their description is worded or how they are shown in the drawing. Shown are:

DESCRIPTION OF THE PREFERRED EMBODIMENTS

Figure 1:
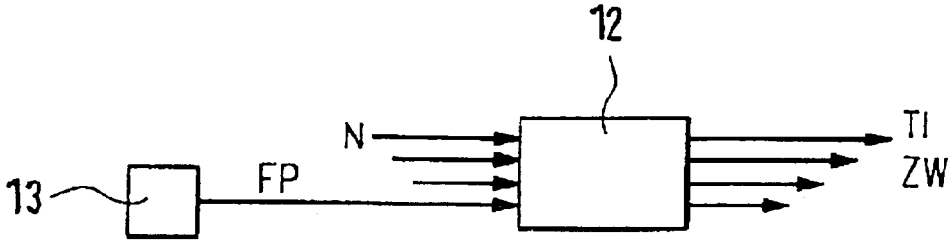
FIG. 1, a schematic block circuit diagram of an internal combustion engine according to the invention of a motor vehicle, in a preferred exemplary embodiment.
Figure 1:
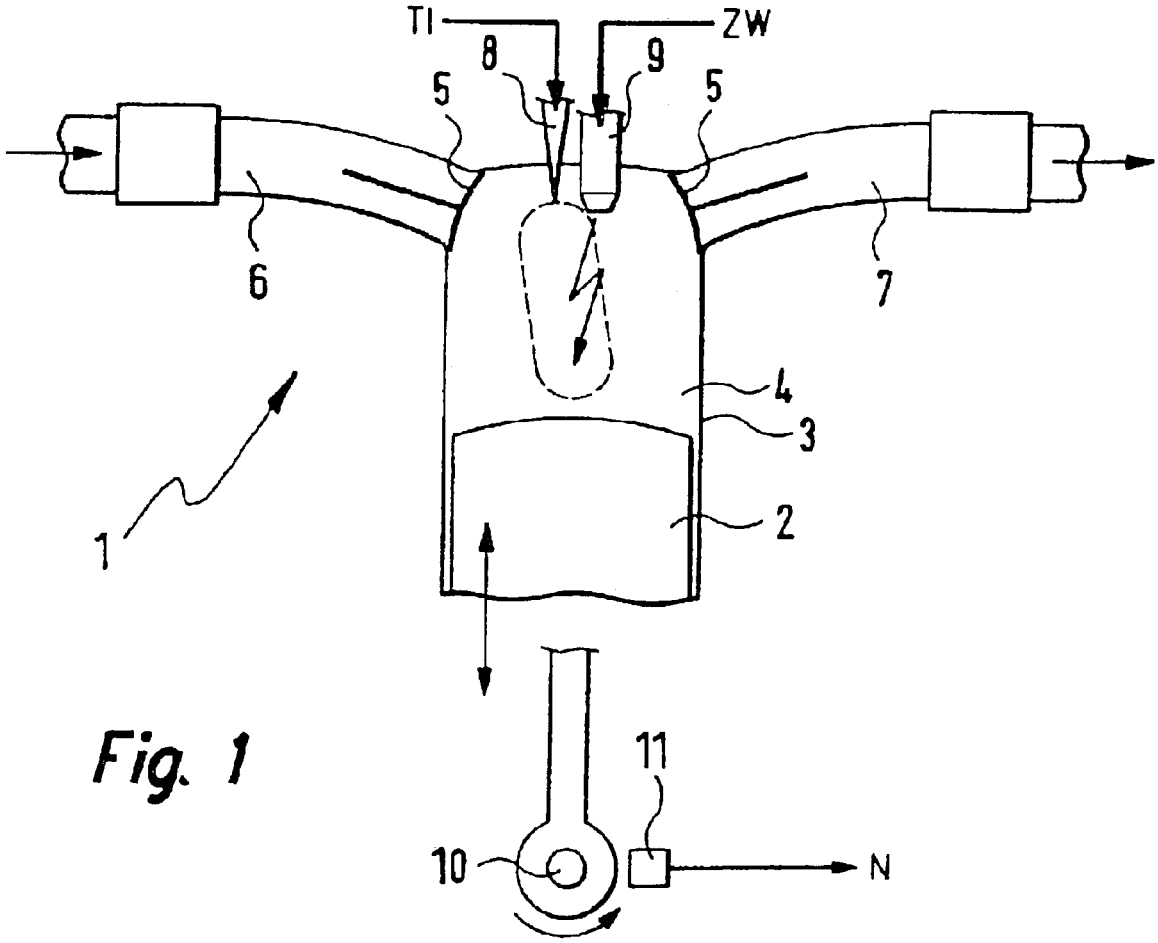

In FIG. 1, an internal combustion engine in its entirety is identified by reference numeral 1. The engine 1 has a piston 2, which is movable back and forth in a cylinder 3. The cylinder 3 is provided with a combustion chamber 4, to which an intake tube 6 and an exhaust pipe 7 are connected. An injection valve 8, which is triggerable with a signal TI, and a spark plug 9 that is triggerable with a signal ZW are also associated with the combustion chamber 4.

In a first mode of operation, that is, in stratified operation of the engine 1, the fuel is injected by the injection valve 8 into the combustion chamber 4 during a compression phase that is brought about by the piston 2, specifically being injected locally into the immediate vicinity of the spark plug 9 and in chronological terms immediately before top dead center OT of the piston 2, that is, before the instant of ignition. Then with the aid of the spark plug 9, the fuel is ignited, so that the piston 2 in the then-ensuing working phase is driven by the expansion of the ignited fuel.

In a second mode of operation, that is, in homogeneous operation of the engine 1, the fuel is injected by the injection valve 8 into the combustion chamber 4 during an aspiration phase that is brought about by the piston 2. By means of the simultaneously aspirated air, the injected fuel is made turbulent and thus distributed essentially uniformly (homogeneously) within the combustion chamber 4. After that, the fuel-air mixture is compressed during the compression phase, and then is ignited by the spark plug 9. The piston 2 is driven by the expansion of the ignited fuel.

In both the stratified mode and the homogeneous mode of operation, a crankshaft 10 is set by the driven piston 2 into a rotary motion, by way of which in the final analysis the wheels of the motor vehicle are driven. An rpm sensor 11 is assigned to the crankshaft 10 and generates a signal N as a function of the rotary motion of the crankshaft 10.

The fuel, in both stratified and homogeneous operation, is injected into the combustion chamber 4 via the injection valve 8 at a high pressure. To that end, an electric fuel pump is provided as a prefeed pump, and a high-pressure pump is also provided; the high-pressure pump can be driven either by the engine 1 or by an electric motor. The electric fuel pump is driven independently of the engine 1 and generates a so-called rail pressure EKP of at least 3 bar, while the high-pressure pump generates a rail pressure HD of up to about 200 bar.

The fuel quantity injected into the combustion chamber 4 by the injection valve 8 in both stratified and homogeneous operation is controlled and/or regulated by a control unit 12, in particular with a view to low fuel consumption and/or low pollutant emissions. To that end, the control unit 12 is provided with a microprocessor, which has stored a program in memory, in a control element and in particular a read-only memory, that is suitable for performing the entire process of control and/or regulation.

The control unit 12 is acted upon by input signals, which represent operating parameters of the engine 1 that are measured by means of sensors. For instance, the control unit 12 is connected to an air flow rate meter disposed in the intake tube 6, a lambda sensor disposed in the exhaust pipe 7, and/or the rpm sensor 11. The control unit 12 is furthermore connected to an accelerator pedal sensor 13, which generates a signal FP that indicates the position of an accelerator pedal that can be actuated by a driver.

The control unit 12 generates output signals, with which the behavior of the engine 1 can be varied by way of actuators in accordance with the desired control and/or regulation. For instance, the control unit 12 is connected to the injection valve 8 and the spark plug 9 and generates the signals TI, ZW required for triggering them.

Figure 2:
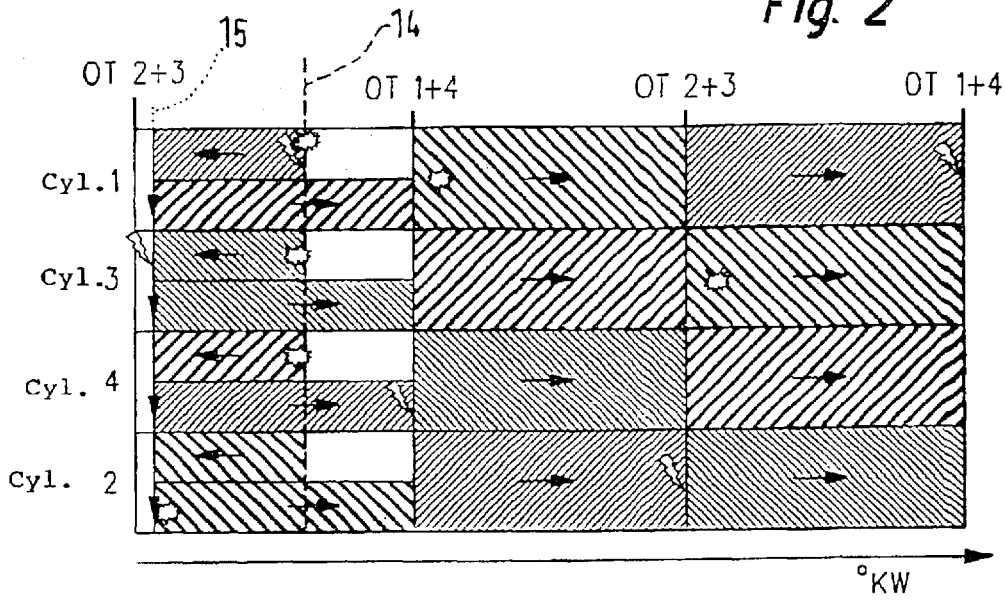
FIG. 2, a schematic diagram of a first exemplary embodiment of a method according to the invention for starting the engine of FIG. 1.
Figure 3:
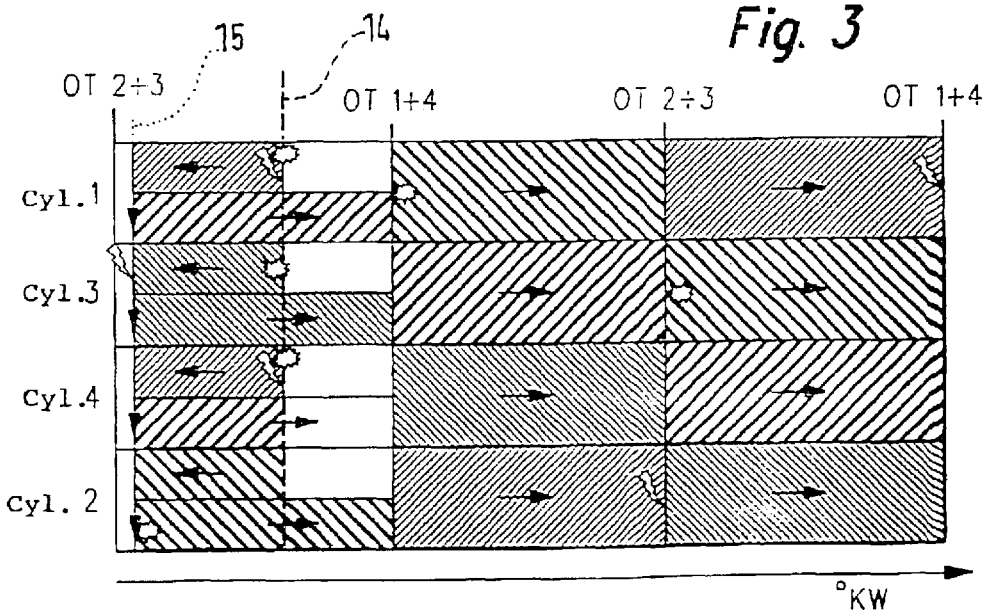
FIG. 3, a schematic diagram of a second exemplary embodiment of a method according to the invention for starting the engine of FIG. 1.
Figure 3:
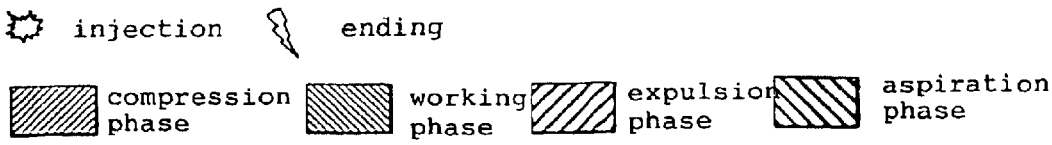

In FIGS. 2 and 3, two different methods of the invention for starting a four-cylinder internal combustion engine 1 are shown schematically in the form of diagrams. The individual lines of the diagrams pertain to the particular indicated cylinder 3 of the engine 1. The various cylinders 3 are identified by numbers. The individual columns of the diagram pertain to the phases or strokes in which the piston 2 of the associated cylinder 3 is located. Each of the pistons 2 can be in an aspiration phase, a compression phase, a working phase, or an expulsion phase. The transitions between the individual phases are characterized by top dead center OT of the pistons 2. To this extent, the horizontal axis along the phases of the piston 2 represents an angle of rotation in ° KW of the crankshaft 10. Dashed lines and the reference numeral 14 designate the position of the engine 1 before starting, that is, the position at a standstill of the engine 1. The dotted line 15 indicates the turning point in the rotary motion of the crankshaft 10 at which the direction of rotation changes from a reverse rotation to a forward rotation.

In the methods shown in the drawings and described below, the rpm sensor 11 is embodied as an absolute angle encoder. This means that at all times, and in particular including the engine 1 has been stopped, the rpm sensor 11 generates the angle of rotation ° KW and sends it to the control unit 2. In this way, at the onset 14 of the starting process, the position of the pistons 2 in the cylinders 3 can be ascertained. Alternatively, the crankshaft 10 can be set into a requisite revolution by an electric motor starter, so that the rpm sensor 11 can signal the position of the piston 2.

In the method of FIG. 2, when the engine 1 is at a standstill, the cylinders 3 are in various phases, that is, a compression phase (cylinder No. 1), a working phase (No. 2), an expulsion phase (No. 3), and an aspiration phase (No. 4). The inlet and outlet valves 5 of cylinder No. 1 are initially closed. The piston 2 of cylinder No. 1 is located—viewed in the forward direction—before top dead center OT. At the onset 14 of the starting process, fuel is injected into the combustion chamber 4 of cylinder No. 1. If the high-pressure pump is driven by the engine 1, then the injection takes place only at the rail pressure EKP of the electric fuel pump. Otherwise—that is, when the high-pressure pump is driven independently of the engine 1—the fuel, for the sake of mixture preparation, is injected into the combustion chamber 4 at high pressure. Then the injected fuel is likewise ignited in the compression phase. The consequence is a first combustion, by means of which the crankshaft 10 is set into a rotary motion oriented in reverse.

Immediately after that, fuel is injected into cylinders No. 3 and No. 4. The valves 5 of cylinder No. 3 are closed. During the reverse motion, the piston 2 moves upward, and the fuel-air mixture located in cylinder No. 3 is compressed. With increasing compression, the motion oriented in reverse of the crankshaft 10 is slowed down, until finally, at a turning point 15, it comes to a complete stop. Just before top dead center OT is reached, the compressed fuel-air mixture is ignited, and a second combustion ensues, which accelerates the crankshaft 10 in the forward direction. The course of motion shown is on the condition, for the first injection, of a suitably low metered fuel quantity, so that the engine 1 does not, as a consequence of the first combustion, expand in the reverse direction beyond top dead center OT of cylinders No. 2 and No. 3.

During the injection of the fuel into cylinder No. 4, the piston thereof is—viewed in the forward direction—in an expulsion phase, which in the present case, in the reverse motion of the engine 1, is equivalent to an aspiration phase. The fuel injected into cylinder No. 4 is ignited, during the forward motion of the engine 1, toward the end of the compression phase, which brings about a third combustion and a further acceleration of the crankshaft 10 in the forward direction. It is understood that the onset of injection can also be shifted into the continuing compression phase—during the forward motion of the engine 1—if the injection pressure is high enough.

Thus the actual starting process in the forward direction, in the method of the invention, always begins from the turning point 15, at which the pistons 2 in the cylinders 3 have an optimal position. On the one hand, the cylinders, whose pistons are—viewed in the forward direction—in the working phase are filled with a relatively large air mass. The combustion energy resulting from the combustion of the fuel injected into the combustion chamber thus furnishes a sufficiently high starting energy to start the engine. On the other hand, the spacing between the injection valve 8 and the surface of the piston 2 is so large that the fuel injected into the combustion chamber 4 changes over virtually completely into an easily ignitable fuel-air mixture, in the form of a fuel cloud.

The further injections, ignitions, and positions of the valves 5 are shown in the diagram, taking as an example cylinder No. 2 and cylinder No. 1. Accordingly, the further injections ensue during the aspiration phase of the respective cylinder 3. Alternatively, the further injections can also occur during the compression phase, if the injection pressure is high enough. The further injections occur toward the end of the compression phase, just before or just after top dead center OT is reached.

The inlet and outlet valves 5 of the combustion chamber 4 are adjusted by means of a camshaft-free control. To that end, each inlet and outlet valve 5 is equipped with its own control device. As a result, the valves 5 can be opened and closed independently and—if the freedom of valve motion allows it—freely. In this way, it is successfully possible to change from an aspiration phase to a working phase, and vice versa. It is correspondingly possible to change from a compression phase to an expulsion phase and vice versa.

As a result, after an unsuccessful first attempt at starting, the phases of all the cylinders 3 can easily be inverted for a second attempt at starting; that is, a switchover is made between the compression phase and the expulsion phase and between the working phase and aspiration phase. An unsuccessful first attempt at starting exists for instance if the engine 1 is not moving, or if the first compression resistance could not be overcome. In the exemplary embodiment of FIG. 2, accordingly in the second attempt at starting, for cylinder No. 4 at the onset 14 of the starting process, it is the expulsion phase that is involved—viewed in the forward direction. Fuel is injected into the combustion chamber 4 of cylinder No. 4 and ignited. The first combustion puts the engine 1 in a reverse motion. Fuel is then injected into cylinders No. 2 and No. 1. Cylinder No. 2 is in the working phase—viewed in the forward direction. Viewed in the reverse direction—just before top dead center is reached—the fuel injected into cylinder No. 2 is ignited. A second combustion ensues, causing a forward motion of the engine 1. During the reverse motion of the engine 1, the piston of cylinder No. 1 is in a downward motion, which is equivalent to an aspiration phase. The fuel injected into cylinder No. 1 is ignited in the forward motion of the engine 1, toward the end of the compression phase. In the further course of the starting process, fuel is then injected into cylinder No. 3 and subsequently into all the other cylinders in the aspiration phase or the compression phase, and is ignited toward the end of the compression phase.

To reduce the compression resistance during the starting process of the invention, each compression phase that has been run through can be suitably shortened by late closure of the corresponding inlet valves 5—which are open during the aspiration phase that occurs before the compression phase. The method described can be employed with suitable modifications in engines 1 with more than four cylinders as well.

In the method of FIG. 3, cylinder No. 1 and cylinder No. 4 are in the working phase, because of closure of the valves 5. Fuel is injected simultaneously into both cylinders 3 and ignited. The double combustion leads to a powerful initial acceleration of the crankshaft 10. Because of the double combustion, at the onset 14 of the starting process, there are sufficient reserves so that any frictional and compression resistances of the engine 1 can be reliably overcome.

All the further injections, ignitions and valve positions correspond to those of the method of FIG. 1 and can be learned directly from the diagram in FIG. 3. It is understood that in this embodiment of the method of the invention as well, the compression resistances can be reduced by suitably shortening each executed compression phase, which is done by late closure of the corresponding inlet valves 5. With suitable modifications, this embodiment of the method of the invention can also be employed in engines 1 that have more than four cylinders.

What is claimed is:

1. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whose piston (2) is located before a top dead center (OT), as viewed in the forward direction, into a position corresponding to a compression phase; and starting the engine (1) in the forward direction.

2. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whose piston (2) is located before a too dead center (OT), as viewed in the forward direction, into a position corresponding to a compression phase; and starting the engine (1) in the forward direction, wherein the inlet and/or outlet valves (5) of two cylinders (3), whose pistons (2) are located before a top dead center (OT) as viewed in the forward direction are brought into a position corresponding to the compression phase before the starting process.

3. The method claim 1, wherein during the rotary motion of the engine (1) in the reverse direction, the inlet and/or outlet valves (6) of a cylinder (3), whose piston (2) is located—viewed in the forward direction—in an aspiration phase, are actuated in a targeted way such that the rotary motion of the engine (1) in the reverse direction comes to a stop before bottom dead center (UT) of the piston (2) of the at least one cylinder (3) is reached.

4. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whos piston (2) is located before a top dead center (OT), as viewed in the forward direction, into a position corresponding to a compression phase; and starting the engine (1) in the forward direction, wherein during the rotary motion of the engine (1) in the reverse direction, the inlet and/or outlet valves (5) of a cylinder (3), whose piston (2) is located—viewed in the forward direction—in an aspiration phase, are actuated in a targeted way such that the rotary motion of the engine (1) in the reverse direction comes to a stop before bottom dead center (UT) of the piston (2) of the at least one cylinder (3) is reached, and wherein the inlet and outlet valves (5) of the cylinder (3) whose piston (2) is located—viewed in the forward direction—in an aspiration phase, are closed during the rotary motion of the engine (1) in the reverse direction.

5. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whose piston (2) is located before a top dead center (OT), as viewed in the forward direction, into a position corresponding to a compression phase; and starting the engine (1) in the forward direction, wherein during the rotary motion of the engine (1) in the reverse direction, the inlet and/or outlet valves (5) of a cylinder (3), whose piston (2) is located—viewed in the forward direction—in an aspiration phase, are actuated in a targeted way such that the rotary motion of the engine (1) in the reverse direction comes to a stop before bottom dead center (UT) of the piston (2) of the at least one cylinder (3) is reached, wherein the inlet and outlet valves (5) of the cylinder (3) whose piston (2) is located—viewed in the forward direction—in an aspiration phase, are closed during the rotary motion of the engine (1) in the reverse direction, and wherein the inlet and outlet valves (5) of the cylinder (3) whose piston (2) is located—viewed in the forward direction—in an aspiration phase, are kept closed for a predeterminable period of time after the reversal of the direction of rotation of the engine (1).

6. The method of claim 1, wherein during the rotary motion of the engine (1) in the reverse direction, fuel is injected into a combustion chamber (4) of a further cylinder (3), whose piston (2) is located—viewed in the forward direction—in a working phase, and the fuel compressed in the combustion chamber (4) of the at least one cylinder is ignited before—viewed in the reverse direction—a top dead center (OT) is reached.

7. The method of claim 6, wherein in a further course of the starting process, fuel is injected into a combustion chamber (4) of a cylinder (3), whose piston (2) is located—viewed in the forward direction—in an aspiration phase or a compression phase, and the fuel compressed in the combustion chamber (4) of the at least one cylinder (3) is ignited.

8. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whose piston (2) is located before a top dead center (OT), as viewed in the forward direction, into a position corresponding to a compression phase; and starting the engine (1) in the forward direction, wherein after an unsuccessful first ignition of the fuel injected into the at least one cylinder (3), the method is performed again, with inverted phases of the individual cylinders (3).

9. A method for stating a multi-cylinder internal combustion engine (1) in the forward direction, comprising the following steps:

ascertaining the position of a piston (2) in a cylinder (3) of the engine (1);

injecting fuel into a combustion chamber (4) of the particular cylinder (3) whose piston (2) is in a working phase;

moving the engine (i) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (6) of the at least one cylinder (3) whose piston (2) is located before a top dead center (OT), as viewed in the forward direction, into a position corresponding to a compression phase; and starting the engine (1) in the forward direction, wherein during the starting process in a compression phase of a cylinder (3) of the engine (1), the corresponding inlet valve (5) of the cylinder (3) is closed late.

10. The method claim 1, wherein the fuel compressed in a combustion chamber (4) of a cylinder (3) is ignited just before the top deed center (OT) of the piston (2) of the cylinder (3) is reached, toward the end of the compression phase.

11. A control element formed as a read-only memory or flash memory for a control unit (12) of an internal combustion engine (1) in which a program is stored that can be run on a computing device, in particular a microprocessor, and is suitable for performing a method including the following steps:

ascertaining the position of a piston (2) in a cylinder (3) of the engine (1);

injecting fuel into a combustion chamber (4) of the particular cylinder (3) whose piston (2) is in a working phase;

moving the engine (1) first in a reverse direction, by the injection of fuel into a combustion chamber (4) of at least one cylinder (3) whose piston (2) is in a compression phase as viewed in a forward direction;

igniting the fuel compressed in the combustion chamber (4) of the at least one cylinder (3), wherein the rotary motion in the reverse direction comes to a stop before the bottom dead center (UT) of the piston (2) of the at least one cylinder (3) is reached;

placing inlet and/or outlet valves (5) of the at least one cylinder (3) whose piston (2) is located before a top dead center (OT), as viewed in the forward direction, into a position corresponding to a compression phase; and starting the engine (1) in the forward direction.

12. A multi-cylinder internal combustion engine (1), in particular of a motor vehicle, wherein the engine (1) has a detector for ascertaining the position of a piston (2) in a cylinder (3) of the engine (1) and a fuel motoring system for injecting fuel into a combustion chamber (4) of a particular cylinder (3) whose piston (2) is located in a working phase, and a spark plug (9) for igniting fuel compressed in the combustion chamber (4), characterized in that wherein the fuel metering system injects fuel into the combustion chamber (4) of at least one cylinder (3), whose piston (2) is located—viewed in the forward direction—in a compression phase; that the spark plug (9) ignited the fuel compressed in the combustion chamber (4) of the at least one cylinder (3), thereby causing a rotary motion of the engine in the reverse direction, which is ended before the bottom dead center (UT) of the pistons (2) of the at least one cylinder (3) is reached; and that means for starting the engine (1) start the engine in the forward direction, wherein inlet and/or outlet valves (5) of the at least one cylinder (3) whose piston (2) is located before a top dead center (OT), as viewed in the forward direction, are placed into a position corresponding to a compression phase before the engine is started.

13. The engine (1) of claim 12, wherein the engine (1) has a camshaft-free control of the inlet and/or outlet valves (5) of the combustion chambers (4).

14. The engine (1) of claim 12 or 13, wherein the fuel metering system has a high-pressure pump, driven independently of the engine (1), for building up a fuel injection pressure.

15. A control unit (12) of a multi-cylinder internal combustion engine (1), in particular of a motor vehicle, wherein the engine (1) has a detector for ascertaining the position of a piston (2) in a cylinder (3) of the engine (1), a fuel metering system for injecting fuel into a combustion chamber (4) of the particular cylinder (3) whose piston (2) is located in a working phase, and a spark plug (9) for igniting fuel compressed in the combustion chamber (4), characterized in that the control unit (12) triggers the fuel metering system in such a way that is injects fuel into the combustion chamber (4) of at least one cylinder (3), whose piston (2) is located—viewed in the forward direction—in a compression phase; that the control unit (12) triggers the spark plug (9) in such a way that the spark plug ignites the fuel compressed in the combustion chamber (4) of the at least one cylinder (3), thereby causing a rotary motion of the engine in the reverse direction, which is ended before the bottom dead center (UT) of the pistons (2) of the at least one cylinder (3) is reached; and the control unit (12) has means for starting the engine (1) in such a way that they start it in the forward direction, wherein inlet and/or outlet valves (5) of the at least one cylinder (3) whose piston (2) is located before a top dead center (OT), as viewed in the forward direction, are placed into a position corresponding to a compression phase before the engine is started.

* * * * *